United States Patent [19]

Olms

[11] Patent Number: 4,674,817

[45] Date of Patent: Jun. 23, 1987

[54] MEDICAL TERMINAL CLIP

[75] Inventor: Harald O. Olms, Santa Ana, Calif.

[73] Assignee: Tronomed, Inc., Irvine, Calif.

[21] Appl. No.: 775,643

[22] Filed: Sep. 13, 1985

[51] Int. Cl.[4] ..... H01R 11/00

[52] U.S. Cl. ..... 439/592; 128/639; 439/829

[58] Field of Search ..... 128/639-641, 128/802, 803, 643, 644, 798; 339/61 R, 61 M, 224, 200 P, 255 P, 260, 261

[56] References Cited

U.S. PATENT DOCUMENTS

| | | | |
|---|---|---|---|
| 1,039,279 | 9/1912 | Hammond | 339/261 |
| 1,044,885 | 11/1912 | Hammond | 339/261 |
| 1,291,297 | 1/1919 | Walas | 339/261 |
| 1,294,656 | 2/1919 | Hammond | 339/261 |
| 3,606,881 | 9/1971 | Woodson | 128/641 |
| 4,040,697 | 8/1977 | Ramsay et al. | 339/61 R |
| 4,072,388 | 2/1978 | Dunn | 339/103 R |
| 4,178,052 | 12/1979 | Ekbom et al. | 339/61 R |
| 4,200,348 | 4/1980 | Stupay | 339/61 R |
| 4,206,960 | 6/1980 | Tantillo et al. | 339/61 R |
| 4,220,387 | 9/1980 | Biche et la. | 339/61 R |
| 4,303,293 | 12/1981 | Grunwald | 339/61 R |
| 4,385,793 | 5/1983 | Koford et al. | 339/61 R |
| 4,390,223 | 6/1983 | Zenkich | 339/61 R |
| 4,637,672 | 1/1987 | Peterman et al. | 339/61 R |

FOREIGN PATENT DOCUMENTS

| | | |
|---|---|---|
| 459552 | 5/1928 | Fed. Rep. of Germany . |
| 746326 | 3/1933 | France . |

*Primary Examiner*—Gil Weidenfeld
*Assistant Examiner*—Paula A. Austin
*Attorney, Agent, or Firm*—Price, Gess & Ubell

[57] ABSTRACT

An improved electrical connector for connecting a medical electrode terminal on a patient with a lead wire is provided and comprises an electrical contact member that is embedded in a resilient insulating body member. The body member includes first and second cantilevered arms having circuitous arc segments with their concave surfaces facing towards each other to form an open jaw for receiving therebetween the electrode terminal. The electrical contact member includes a pair of open ended gripping appendages that extend into the open jaw and have respective concave gripping surfaces that face towards each other and are capable of contacting an electrode terminal. The end of the circuitous arc segments are capable of not only closing the body member jaw opening, but also of further locking the respective cantilevered arms to provide additional strength. Support ledges can be positioned on the internal surfaces of the circuitous arc segments to provide further support and a limitation to any adverse movements of the contact gripping appendages.

17 Claims, 8 Drawing Figures is shown. A resilient insulated body member 4 can be molded from a medical grade plastic and includes a base member 6 of a cylindrical configuration that supports first and second cantilevered arms 8 and 10 that extend in a general longitudinal direction, see AA in FIG. 5. Each cantilevered arm supports a circuitous arc segment 12 and 14 that have concave internal surfaces that face towards each other to form an open jaw configuration. This open jaw configuration is specifically designed to receive therebetween a medical terminal electrode post. The exterior surfaces of the arc segments are provided with flutes 16 to improve the gripping surface for a user. The arc segment 12 terminates in a bifurcated lever 18 while the arc segment 14 terminates in a cantilevered prong 20 that is juxaposition to extend between the respective forks or prongs of the bifurcated lever 18. This particular configuration is not only capable of closing the opening of the jaw or female recess after receiving the electrode post, but also for providing additional strength to the configuration by preventing any traverse movement to the plane of the preferred pivotal motion of the cantilevered arms 8 and 10. Thus, attempts to dislodge the medical clip member 2 will cause the interface of the prongs to strengthen the jaw connection and prevent any relative movement of arc segments 12 and 14.

An electrical contact or conductive member 22 can be formed from a stamped metal and includes at one end, crimping jaws 24 for connection to an electrode lead wire 30 and at the other end respective circular arc segments 26 and 28 which are cantilivered into an exposed position in the jaw opening for gripping the medical electrode post. Circular arc segment 26 is connected to a support extension 32 which is in turn, connected to a circular arc portion 34 and finally, to the contact leg 36. The circular arc segment 28 along with the support arc segment 38, form an approximately "Y" configuration with the contact leg 40. The respective circular arc segments 26 and 28 are positioned at a lower parallel level from that of the contact legs 36 and 40, as can be seen in FIGS. 6 and 7. The contact member 22 can be stamped from a sheet of electrically conductive metal and not only provides an electrical contact but also strengthens the body member 4 which is molded around the contact member 22.

Referring to FIG. 4, an end view is shown to permit an appreciation of the juxaposition of both the cantilivered prong 20 and the bifurcated lever 18 and also of the respective circular arc segments 26 and 28. Referring to FIGS. 2 and 5, the circular arc segments 12 and 14 further provide respective support ledges 42 and 44 that are positioned at the bottom of their respective arc segments to extend into the jaw opening. These support ledges 42 and 44 are juxapositioned to support the respective cantilevered arc gripping appendages 26 and 28 when fastened to an electrode post. Any upward movement or pulling of the electrode lead wire 30 with a corresponding downward flex of the open ended gripping appendages 26 and 28 would permit the support ledges 42 and 44 to act as stops and support members to prevent any damaging movement or stress on the open ended gripping appendages 26 and 28. Thus the design of the present invention can be easily opened to accomodate the insertion of the terminal post yet it is reinforced when connected to the terminal post to securely fasten it agains dislodgement.

Referring to the side view of the body member 4 shown in FIG. 3, strengthing ribs or side support ledges 46 and 48 are provided on each of the cantilivered arms 8 and 10 to provide additional strength to the design.

While not shown, an alternative embodiment could utilize a single cantilevered prong extended from each of the respective circuitous arc segments 12 and 14 to close the open ended jaw configuration. This configuration, however, will not provide the additional strength that occurs by locking a single cantilevered prong between a bifurcated opening on an arc segment. Additionally, the base member 6 could have a conventional strain relief configuration (not shown) for attachment to the terminal lead wire 30.

As can be seen in FIG. 8, the medical terminal clip 2 of the present invention, when placed in a stressed configuration with the respective circuitous arc segments 26 and 28 contacting an electrode post, provides a closed end configuration with the respective arc segments or gripping appendages 26 and 28 being positioned above the supporting ledges 42 and 44. Thus a very flexible and easily manipulated medical electrical clip is provided for medical personnel while still providing a extremely secure and nontangling attachment to an electrode terminal post when mounted on a patient.

While the above embodiment has been disclosed as the best mode presently contemplated by the inventors, it should be realized that this example should not be interpreted as limiting because artisans skilled in this medical field, once given the present teaching, can vary from the specific embodiments.

Accordingly, the scope of the present invention should be determined solely from the following claims in which we claim:

1. An improved electrical connector for connecting medical electrodes with terminals on a patient with a lead wire to monitoring equipment comprising:

an electrical contact member;

a resilient insulating body member supporting the electrical contact member including first and second cantilevered arms having side support ledges to provide strength and circuitous arc segments with their concave surfaces facing towards each other to form an open jaw for receiving therebetween the terminal of the electrode, the electrical contact member further includes a pair of open ended gripping appendages that extend into the open jaw and have respective concave gripping surfaces that face towards each other and are capable of contacting an electrode; and means for closing the body member jaw opening when the open ended gripping appendages are stressed to a position to receive and fasten onto an electrode terminal, the insulating body member includes a base member wherein each cantilevered arm extends in a parallel spaced configuration from the base member before forming circuitous arc segments.

2. The invention of claim 1 wherein the means for closing includes a bifurcated end on one arm and a cantilevered prong on the other arm, the prong juxapositioned to extend into the bifurcated end when the gripping appendages are fastened onto the electrode.

3. The invention of claim 1 further including a pair of support ledges that are juxapositioned to extend beneath the appendages, when the gripping appendages are attached to an electrode terminal, and to provide support if the gripping appendages are stressed downward.

MEDICAL TERMINAL CLIP

BACKGROUND OF THE INVENTION

1. Field of the Invention

The present invention is directed to an improved medical terminal clip member or electrical connector member for attachment to electrodes connected to a patient and, more particularly, to a medical terminal clip member that can be securely fastened to an electrode terminal post while preventing any entanglements with extraneous objects.

2. Description of the Prior Art

The increased use of electrical instrumentation in the medical field has created demands for a relatively inexpensive but reliable medical terminal clip member. Numerous forms of medical terminal clips have been proposed and are generally formed from a molded plastic body member having an embedded electrically conducting infrastructure that is exposed in a female bore or aperture for connection to a post of a medical electrode. Since a medical terminal clip is frequently part of a medical life support monitoring system and is attached directly to a patient, there has been a continued demand in the medical field to provide electrical connector members that will resist entanglement with foreign objects when the patient moves, for example, while sleeping.

U.S. Pat. No. 4,385,793 discloses one example of a medical terminal clip with an antitangle device. U.S. Pat. No. 4,390,223 discloses another electrical connector having a closed opening that supports a spring connector for contacting a grooved medical electrode post and a flexible web for preventing egress into the open legs of the connector.

U.S. Pat. No. 4,072,388 and U.S. Pat. No. 4,178,052 likewise show barriers to close the open leg portions of a medical terminal clip. U.S. Pat. No. 4,303,293 discloses a relatively elaborate connector for providing a secure fastener to an electrode post. U.S. Pat. Nos. 4,200,348, 4,220,387, and 4,220,387 are cited of general interest and show other forms of medical terminal clips.

Finally, the German Pat. No. 459,552 (1926); French Pat. No. 746,326 (1932); U.S. Pat. Nos. 1,291,297; 1,294,656; 1,044,885; and 1,039,279 are cited of general interest and disclose other forms of connector members for connection to electrical terminal posts.

The medical field is still seeking to find a relatively economical, reliable and secure medical terminal clip member that can be used with confidence on a patient. Since the problems of dislodging the connection of an electrical terminal clip member from an electrode on the patient's skin is a constant and reoccurring problem, the prior art is seeking to optimize a medical terminal clip that will resolve this issue.

SUMMARY OF THE INVENTION

Present invention is directed to a medical terminal clip member for attachment to electrodes connected to a patient and comprises a body member of a relatively flexible insulated material, such as plastic, that supports an electrical contact member that is connected to a terminal wire lead at one end of the clip member and is exposed for secure contact to the electrical terminal post at the other end. The body member has a longitudinal axis and a pair of laterally spaced arm members extending in an approximately longitudinal direction and pivotally connected for relative movement. The spaced arm members have circuitous arc segments with their concave surfaces facing towards each other to form a open jaw configuration for receiving therebetween the electrode terminal post. The electrical contact member that is embodied within the body member includes a crimpled pair of jaws for attachment to a lead wire and a pair of open ended appendages that are cantilevered from the crimping jaws to extend into the open jaw configuration of the body member for contacting the electrode. One appendage extends into the opening from a position at the base of the jaw opening, while the other extends into the opening from a position adjacent the entrance to the jaw opening. Each of these appendages have respective concave gripping surfaces that face towards each other and are capable of a biased contacting of the electrode.

The clip member jaw opening can be closed by cantilevered prongs at the entrance of the jaw opening that are juxapositioned to extend across the opening of the jaw member when the open ended appendages are stressed to a position to receive and fasten onto an electrode. Thus, one feature of the invention is to provide a secure closed configuration to both the arm appendages and the open jaw configuration when the medical terminal clip is fastened to a patient to avoid entanglements. Another feature is to provide an easily opened medical terminal clip member that is further reinforced against dislodging when mounted on a terminal post.

The objects and features of the present invention, which are believed to be novel, are set forth with particularity in the appended claims. The present invention, both as to its organization and manner of operation, together with further objects and advantages thereof, may best be understood by reference to the following description taken in connection with the accompanying drawings.

DESCRIPTION OF THE PRIOR ART

The following description is provided to enable any person skilled in the medical field to make and use the invention and sets forth the best mode contemplated by the inventors of carrying out their invention. Various modifications, however, will remain readily apparent to those skilled in the art since the generic principles of the present invention have been defined herein specifically to provide for a relatively economical, reliable and secure medical terminal clip member that can be used with confidence on a patient.

Figure 1:
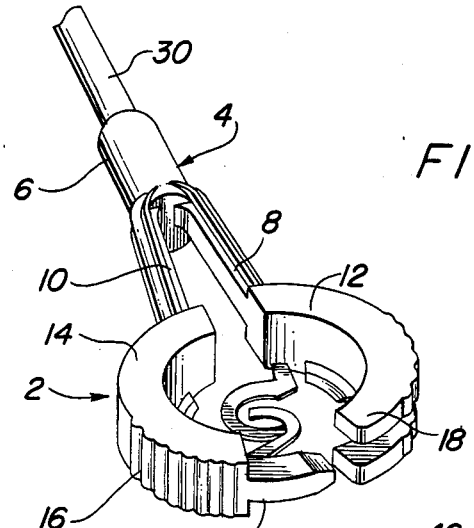
FIG. 1 is a side perspective view of medical terminal clip of the present invention in an open unstressed position.
Figure 2:
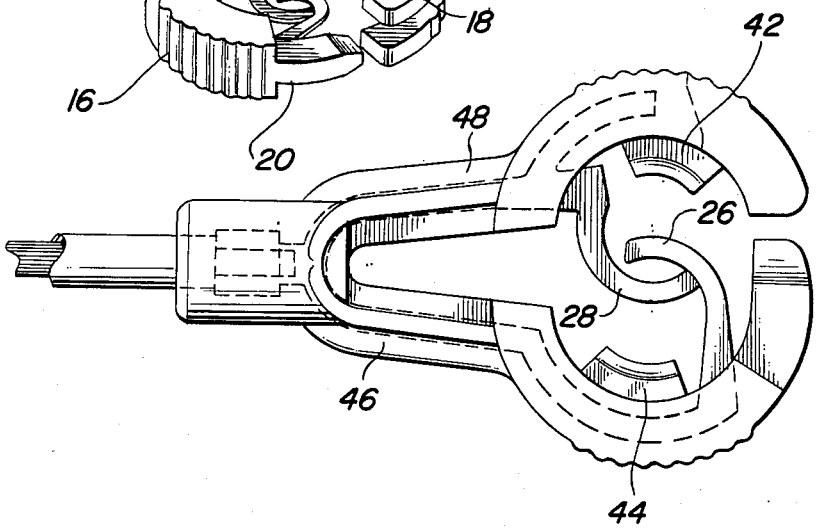
FIG. 2 is a plan view of the invention.
Figure 3:
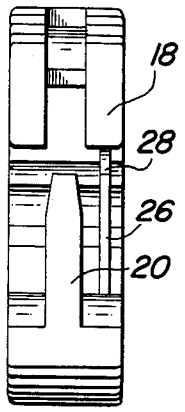
FIG. 3 is a side view of the invention.
Figure 4:
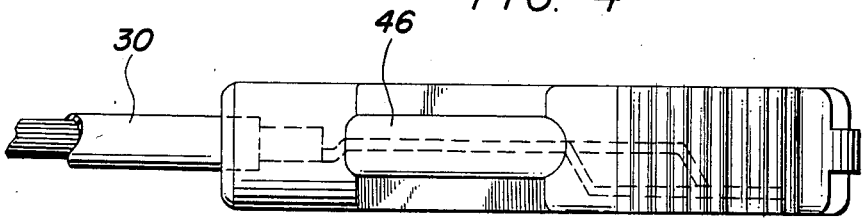
FIG. 4 is a end view from the entrance jaw opening.
Figure 8:
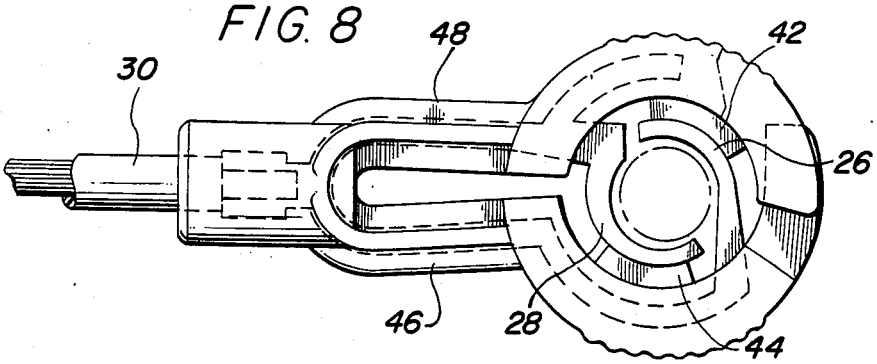
FIG. 8 is another side perspective view of the present invention in a closed stressed position.
Figure 5:
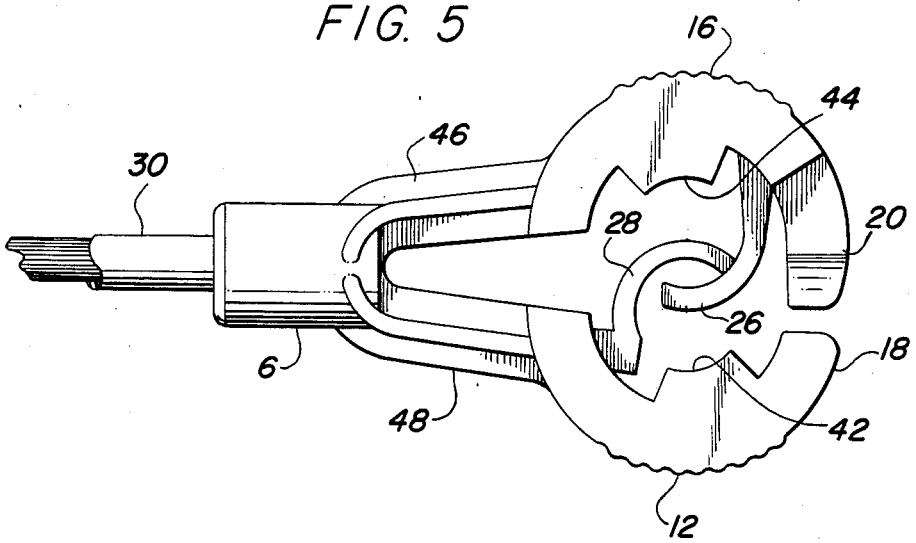
FIG. 5 is a bottom plan view of the medical terminal clip of the present invention showing the longitudinal axis.
Figure 6:
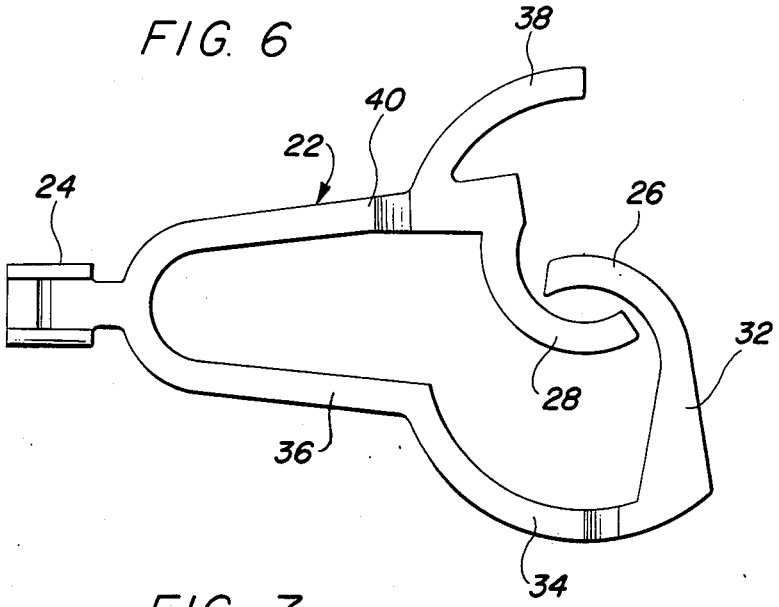
FIG. 6 is a plan view of the conductive electrode member of the present invention.
Figure 7:
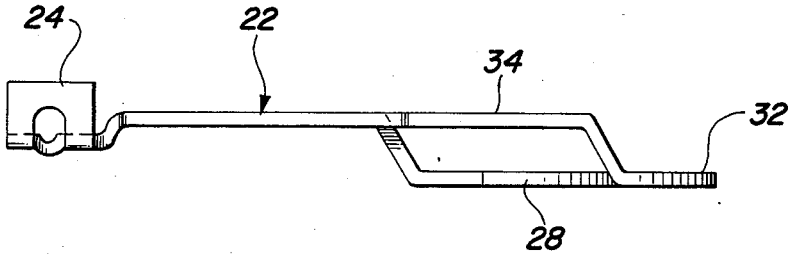
FIG. 7 is a side view of the electrical contact member of the present invention.

Referring to FIGS. 1 and 8, a perspective view of the medical terminal clip member 2 of the present invention 4. The invention of claim 1 wherein the body member includes exterior fluted configurations on each cantilevered arm for grasping by the user.

5. The invention of claim 1 wherein the electrical contact member is bilevel with the gripping appendages lying in one plane and the remaining portions of the contact member lying in a substantially different parallel plane.

6. The invention of claim 5 wherein the contact member is bifurcated into a pair of support members, each supporting a gripping appendage, one of the support members forming an approximately "Y" shape.

7. The invention of claim 6 wherein one of the support members includes a circular arc portion to position a gripping appendage adjacent the opening entrance of the jaw.

8. The invention of claim 7 wherein the gripping appendage is connected to the circular arc portion by a relatively straight support extension member.

9. An electrical connector for connection to a medical electrode terminal on a patient comprising:

a resilient insulating member including a base portion movably supporting first and second cantilevered arms extending from the base portion to form an open jaw-like configuration, the arms are adapted to be relatively moved by manipulation of a user, each of the arms terminate in at least one prong member that is of a dimension to overlap and close the jaw configuration when the electrical connector is fastened to an electrode thereby minimizing occasions of entanglement by the patient with extraneous objects;

connector means for providing an electrical contact with the electrode, the connector means being supported by the resilient insulating member and having an electrical contact member that includes a pair of cantilevered gripping appendages that extend respectively from the cantilevered arms into the opening of the jaw configuration for contacting the electrode terminal; and a pair of support ledges that are juxtapositioned to extend beneath the gripping appendages and to provide support if the gripping appendages are stressed downward.

10. The invention of claim 9 wherein the exterior surface of the insulating member includes a series of flutes to facilitate gripping by a user.

11. A medical terminal clip member for attachment to electrode terminals connected to a patient comprising:

a resilient insulating body member molded from a plastic material having a central longitudinal axis and a pair of spaced arm members extending in an approximately longitudinal direction and pivotally connected for relative movement, the spaced arm members having circuitous arc segments with their concave surfaces facing towards each other to form an open jaw configuration for receiving therebetween the electrode terminal; and conductive means for providing an electrical path is embedded in the body member and provides additional strength to the clip member, the conductive means includes a pair of open ended gripping appendages that are cantilevered to extend into the open jaw configuration for contacting the electrode, the body member further including a support ledge at the bottom of each arc segment for providing a limit to any movement of the contact gripping appendages in a downward direction.

12. The invention of claim 11 further including means for closing the body member when the open ended gripping appendages are stressed to a position to receive and fasten onto an electrode.

13. The invention of claim 12 wherein the open ended gripping appendages have respective concave gripping surfaces that face towards each other, one gripping appendage extending from the beginning of the arc segment into the jaw opening while the other gripping appendage extends from the end of the other arc segment into the jaw opening.

14. The invention of claim 13 wherein the means for closing includes a bifurcated lever end on one arm and a prong on the other arm for extending between the bifurcated lever when the gripping appendages are fastened onto the electrode.

15. An improved electrical connector for connecting medical electrodes with terminals on a patient with a lead wire to monitoring equipment comprising:

an electrical contact member;

a resilient insulating body member supporting the electrical contact member including first and second cantilevered arms to provide strength and circuitous arc segments with their concave surfaces facing towards each other to form an open jaw, with an entrance and base portion, for receiving therebetween the terminal of the electrode, the contact member having a pair of contact legs positioned in a first plane and a pair of gripping appendages positioned in a second plane and extending from the respective contact legs, parallel to the first plane, the pair of open ended gripping appendages are cantilevered into the open jaw and have respective concave gripping surfaces that face towards each other and are capable of contacting an electrode, one cantilevered gripping appendage extends into the open jaw adjacent an entrance of the open jaw while the other cantilevered gripping appendage extends into the open jaw from a position adjacent the base portion of the open jaw, the contact leg attached to the gripping appendage extending into the open jaw adjacent the base portion further comprises a support arc element extending towards the open jaw entrance to provide strength to the resilient insulating body member; and means for closing the body member jaw opening when the open ended gripping appendages are stressed to a position to receive and fasten onto an electrode terminal, the insulating body member includes a base member wherein each cantilevered arm extends in a parallel spaced configuration from the base member before forming the circuitous arc segments.

16. An improved electrical connector for connecting medical electrodes with terminals on a patient with a lead wire to monitoring equipment comprising:

an electrical contact member;

a resilient insultating body member supporting the electrical contact member including first and second cantilevered arms to provide strength and circuitous arc segments with their concave surfaces facing towards each other to form an open jaw for receiving therebetween the terminal of the electrode, the contact member having a pair of contact legs positioned in a first plane and a pair of open ended gripping appendages positioned in a second plane, parallel to the first plane, the pair of open ended gripping appendages are cantilevered into the open jaw and have respective concave gripping surfaces that face towards each other and are capable of contacting an electrode and a pair of support ledges that are juxtapositioned to extend beneath the gripping appendages and to provide support if the gripping appendages are stressed downward, and means for closing the body member jaw opening when the open ended gripping appendages are stressed to a position to receive and fasten onto an electrode terminal, the insulating body member includes a base member wherein each cantilevered arm extends in an approximately parallel spaced configuration from the base member before forming the circuitous arc segments.

17. The invention of claim 16 wherein the support ledges are positioned approximately in the second plane.

* * * * *